US006453675B1

(12) United States Patent
Royle

(10) Patent No.: US 6,453,675 B1
(45) Date of Patent: Sep. 24, 2002

(54) COMBUSTOR MOUNTING FOR GAS TURBINE ENGINE

(75) Inventor: Eric Edward Royle, Wigston (GB)

(73) Assignee: ABB Alstom Power UK Ltd., Lincoln (GB)

( * ) Notice: Subject to any disclaimer, the term of this patent is extended or adjusted under 35 U.S.C. 154(b) by 0 days.

(21) Appl. No.: 09/699,066

(22) Filed: Oct. 27, 2000

(30) Foreign Application Priority Data

Oct. 27, 1999 (GB) ..... 9925296

(51) Int. Cl.[7] ..... F02C 7/20
(52) U.S. Cl. ..... 60/800
(58) Field of Search ..... 60/39.02, 39.31, 60/39.32, 800; 264/29.7

(56) References Cited

U.S. PATENT DOCUMENTS

| | | | | |
|---|---|---|---|---|
| 3,999,376 A | | 12/1976 | Jeryan et al. | |
| 4,322,945 A | * | 4/1982 | Peterson et al. | 60/39.32 |
| 4,363,208 A | * | 12/1982 | Hoffman et al. | 60/39.32 |
| 4,365,470 A | * | 12/1982 | Matthews et al. | 60/39.32 |
| 4,454,711 A | | 6/1984 | Ben-Porat | |
| 5,592,814 A | | 1/1997 | Palusis et al. | |
| 5,622,041 A | * | 4/1997 | Feeley et al. | 60/39.02 |
| 5,840,221 A | * | 11/1998 | Lau et al. | 264/29.7 |

FOREIGN PATENT DOCUMENTS

| | | |
|---|---|---|
| GB | 1 476 414 | 6/1977 |
| GB | 2 147 405 A | 5/1985 |
| JP | 05118549 | 5/1993 |

* cited by examiner

*Primary Examiner*—Michael Koczo
(74) *Attorney, Agent, or Firm*—Kirschstein, et al.

(57) ABSTRACT

A combustion chamber is supported in a gas turbine engine by a mounting having a first attachment assembly secured to a wall of the combustion chamber, and a second attachment assembly secured to a support structure rigidly mounted from an engine housing. The first attachment assembly includes a pair of clamp surfaces pressed by a spring to grip parallelly-spaced inner and outer surfaces of the wall. Radial thermal expansion and contraction of the wall, relative to the first attachment assembly, are accommodated by allowing radial slippage between the clamp surfaces and the gripping surfaces. The second attachment assembly includes a spring which permits the combustion chamber and the mounting to tilt relative to the support structure. By accommodating both differential radial movement and tilting, the thermal stresses in the material forming the combustion chamber are reduced.

16 Claims, 2 Drawing Sheets

COMBUSTOR MOUNTING FOR GAS TURBINE ENGINE

FIELD OF THE INVENTION

This invention is concerned with the mounting of a combustion chamber in a gas turbine engine, and also to a combustion chamber mounting for supporting a combustion chamber within a gas turbine engine. More particularly, this invention is concerned with providing a combustion chamber mounting that will relieve stress resulting from differential thermal movement between a combustion chamber and surrounding structures to which the combustion chamber is attached.

BACKGROUND OF THE INVENTION

In designing a gas turbine engine, it is desirable to increase the firing temperature to achieve greater thermal efficiency, and this entails the use of high temperature materials for the combustion chambers and associated transition ducts. High temperature alloys are commonly used to form a combustion chamber, but firing temperatures have risen above the highest operational temperature of these special alloys, necessitating either the provision of a cooling system (which increases manufacturing cost and reduces thermal efficiency), or forming the combustion chamber from a ceramic material capable of operating at the higher temperature.

A gas turbine combustion chamber is usually supported from a support structure, such as an engine or compressor casing, by at least one mounting. Under operating conditions, all of these components undergo thermal expansion which has to be accommodated by the design in order to avoid excessive stresses and strains.

Ceramic materials typically have a lower coefficient of thermal expansion than the materials forming the mounting and the associated support structure, with the consequence that substantial differential thermal expansion occurs between a ceramic combustion chamber and its mounting Although a ceramic combustion chamber enables a higher firing temperature to be used, the stresses and strains, caused by thermal expansion and distortion of the combustion chamber and also by differential thermal expansion between the combustion chamber and its mounting, can result in failure of the combustion chamber by cracking due to the inherent brittleness of the ceramic material.

It is known from UK Patent Specification GB 1,476,414 for a ceramic combustion chamber to have a generally cylindrical side wall and a discharge end located, with freedom for axial expansion and contraction, within ducting for receiving the combustion products. An upstream end of the chamber is closed by an integral dome portion defining a central circular opening for an annular abutment which locates the fuel spray nozzle. This annular abutment is rigidly secured by studs to a combustion chamber cover and includes an annular flange which supports a slightly yieldable or resilient gasket positioned to react against the inner surface of the dome portion around the central circular opening. This inner surface of the dome portion is urged towards the rigid annular flange by a spring which reacts between structure rigidly mounted from the combustion chamber cover, and a rigid washer which bears against the outer surface of the dome portion around the central circular opening. There is no teaching concerning the accommodation of differential radial movement between the ceramic combustion chamber, the annular abutment and the combustion case cover. To the contrary, the spring urges the dome portion against the slightly yieldable or resilient gasket which is rigidly supported by the combustion case cover. The force exerted by this spring is clearly provided to cause the gasket to effect a seal between the rigidly mounted annular abutment and the dome portion of the combustion chamber.

SUMMARY OF THE INVENTION

This invention is based on the realization that stresses caused by thermal expansion and contraction of a combustion chamber, relative to the structures to which it is attached, can be relieved by permitting differential radial movement between the combustion chamber and its mounting, and by also permitting the combustion chamber to tilt relative to the structure from which it is supported. Such tilting can be caused by the thermal gradient between the cooler upstream end and the much hotter downstream end of the combustion chamber, and particularly by any thermal gradient transverse to the combustion chamber. Such transverse thermal gradients can be significant in a gas turbine having an annular array of combustion chambers, the combustion chamber walls adjacent the turbine axis being hotter.

According to one aspect of the invention a gas turbine has a combustion chamber secured to a mounting by a first attachment means arranged to accommodate differential radial movement between the combustion chamber and the mounting, the mounting being secured to a support structure by a second attachment means arranged to permit the combustion chamber to tilt relative to the support structure. In this manner the combustion chamber is positively located and supported by the mounting, which accommodates differential tilting and radial expansion and contraction of the combustion chamber, thereby avoiding the generation of excessive thermal stresses and strains in the material forming the combustion chamber. Whilst reduction of thermal stresses and strains is desirable for most combustion chambers, it is particularly beneficial when the combustion chamber is formed from a ceramic material.

The first attachment means preferably extends through an aperture in a wall of the combustion chamber and defines a pair of opposed surfaces shaped respectively to engage inner and outer surfaces of the combustion chamber wall adjacent the aperture, and the first attachment means also includes a biasing means operative to cause the opposed surfaces to grip the inner and outer surfaces of the combustion chamber wall with a force sufficient to secure the combustion chamber to the mounting whilst permitting differential radial movement between the combustion chamber wall and the opposed surfaces. With this arrangement, one of the opposed surfaces may be defined by a first member that is axially secured to the mounting, the other opposed surface being defined by a second member that is mounted for axial movement relative to the mounting, and the biasing means being arranged to react between the mounting and the second member. In this case an axial adjustment device may be arranged operatively between the first member and the mounting to enable the position of the said one opposed surface to be adjusted axially of the mounting, Preferably the first member is positioned within the combustion chamber.

The second attachment means preferably includes a second biasing device operative to oppose movement of the mounting relative to the support structure.

The mounting may be tubular and surrounds a fuel burner. In this case the support structure is preferably an air inlet guide vane communicating with the combustion chamber through the tubular mounting.

The mounting may include at least one duct for the passage of cooling air.

The combustion chamber is preferably formed of a ceramic material which may comprise woven continuous fibers embedded in a silicon carbide matrix. The surfaces of the first attachment means that are to contact the ceramic combustion chamber are preferably covered with an abradable metallic coating.

According to another aspect of the invention a combustion chamber mounting has:

first attachment means for securing a combustion chamber to the mounting, said first attachment means being capable of accommodating limited differential radial movement between the combustion chamber and the mounting, and second attachment means for securing the mounting to a support structure, said second attachment means being capable of permitting the mounting, and hence the combustion chamber, to tilt a limited amount relative to the support structure.

Further aspects of the invention will be apparent from the following description and the appended claims.

BRIEF DESCRIPTION OF THE DRAWINGS

The invention will now be described, by way of example only, with reference to the accompanying drawings, in which.

DETAILED DESCRIPTION OF THE PREFERRED EMBODIMENTS

Figure 1:
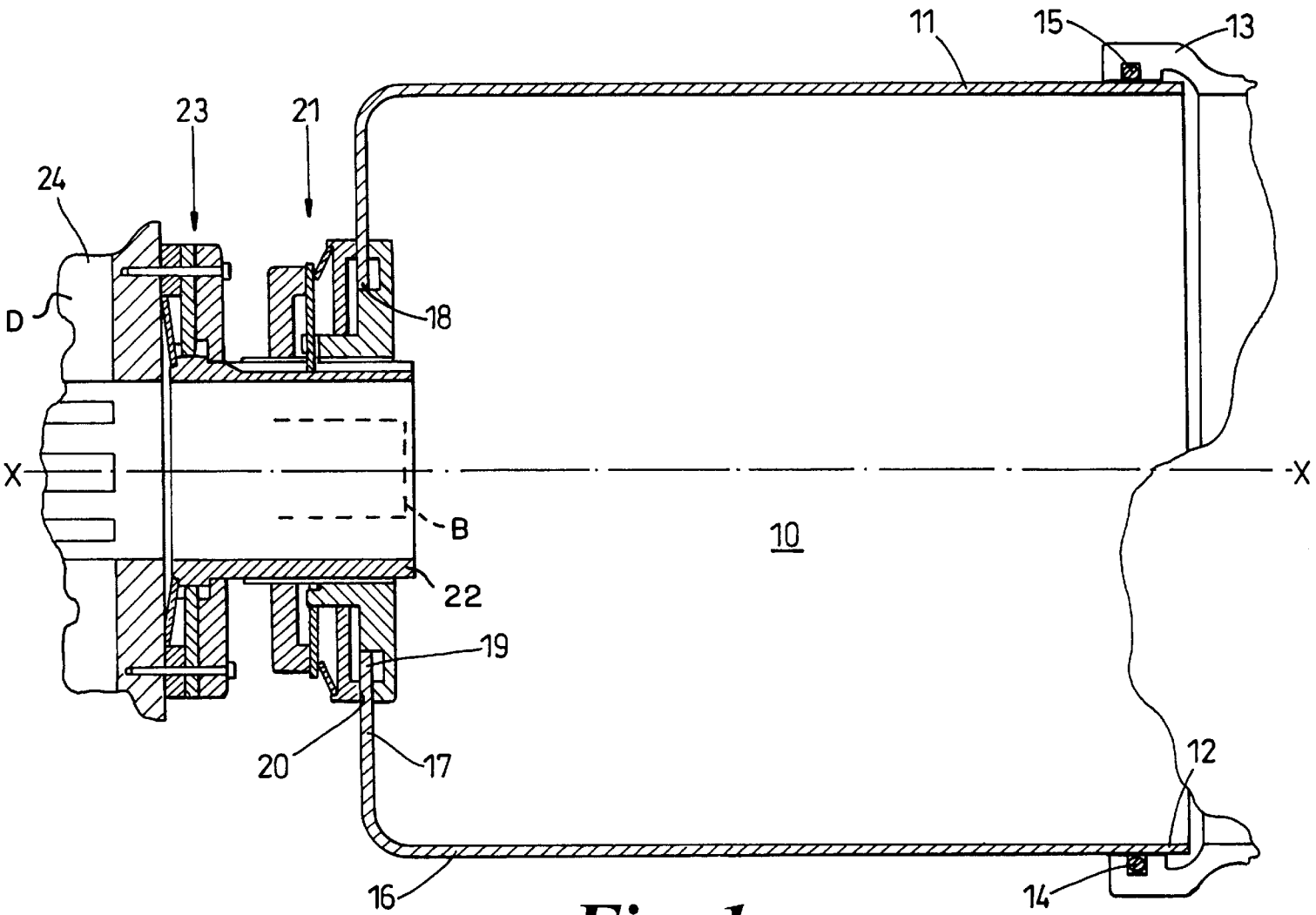
FIG. 1 is a diagrammatic axial section through part of a gas turbine, illustrating the mounting of a ceramic combustion chamber.

With reference to FIG. 1, a combustion chamber 10 has a cylindrical wall 11 of which the downstream end 12 is radially located within a transition duct 13 arranged in known manner to conduct the combustion gases to a compressor turbine and, if appropriate, a power turbine. A piston ring sliding seal 14 is axially located by an internal annular groove 15 formed in the transition duct 13 to permit limited relative axial movement between the combustion chamber 10 and the transition duct 13 in the direction of the cylindrical axis X—X. The upstream end 16 of the combustion chamber 10 is partially closed by an integral radial wall 17 formed with a circular aperture 18 which is preferably coaxial with the axis X—X. Although the wall 17 is illustrated as extending in a radial plane, it may instead be frusto-conical or of another configuration provided that it defines spaced-apart inner and outer surfaces 19, 20 extending substantially parallel to each other and surrounding the edge of aperture 18. In the event that the wall 17 is frusto-conical, it is advantageous for the portions of the inner and outer surfaces 19, 20 immediately surrounding the edge of the aperture 18 to be radial.

The combustion chamber 10 is formed from an appropriate ceramic material, for instance, woven continuous fibers embedded in a silicon carbide matrix. If desired, a thermal insulation layer may be fixed to the internal surfaces of the combustion chamber. However, the combustion chamber could instead be made of any suitable material.

The radial wall 17 is secured by a first attachment means 21 to a tubular mounting 22 which is in turn secured by a second attachment means 23 to a support structure 24 in the form of an inlet guide vane. The support structure 24 is rigidly mounted from an unshown engine housing and serves both to support the mounting 22, and as a duct D to direct a flow of air from the compressor into the mounting 22 which also acts as a housing for a fuel burner B. The second attachment means 23 therefore attaches the mounting 22 to the support structure 24 and constitutes a support structure attachment for the mounting 22. The first attachment means 21 attaches the mounting 22 to the combustion chamber 10 and constitutes a combustion chamber attachment for the mounting 22.

The construction and operation of the first attachment means 21, the mounting 22 and the second attachment means 23 are now described with reference to FIG. 2 which shows the various components to a larger scale.

Figure 2:
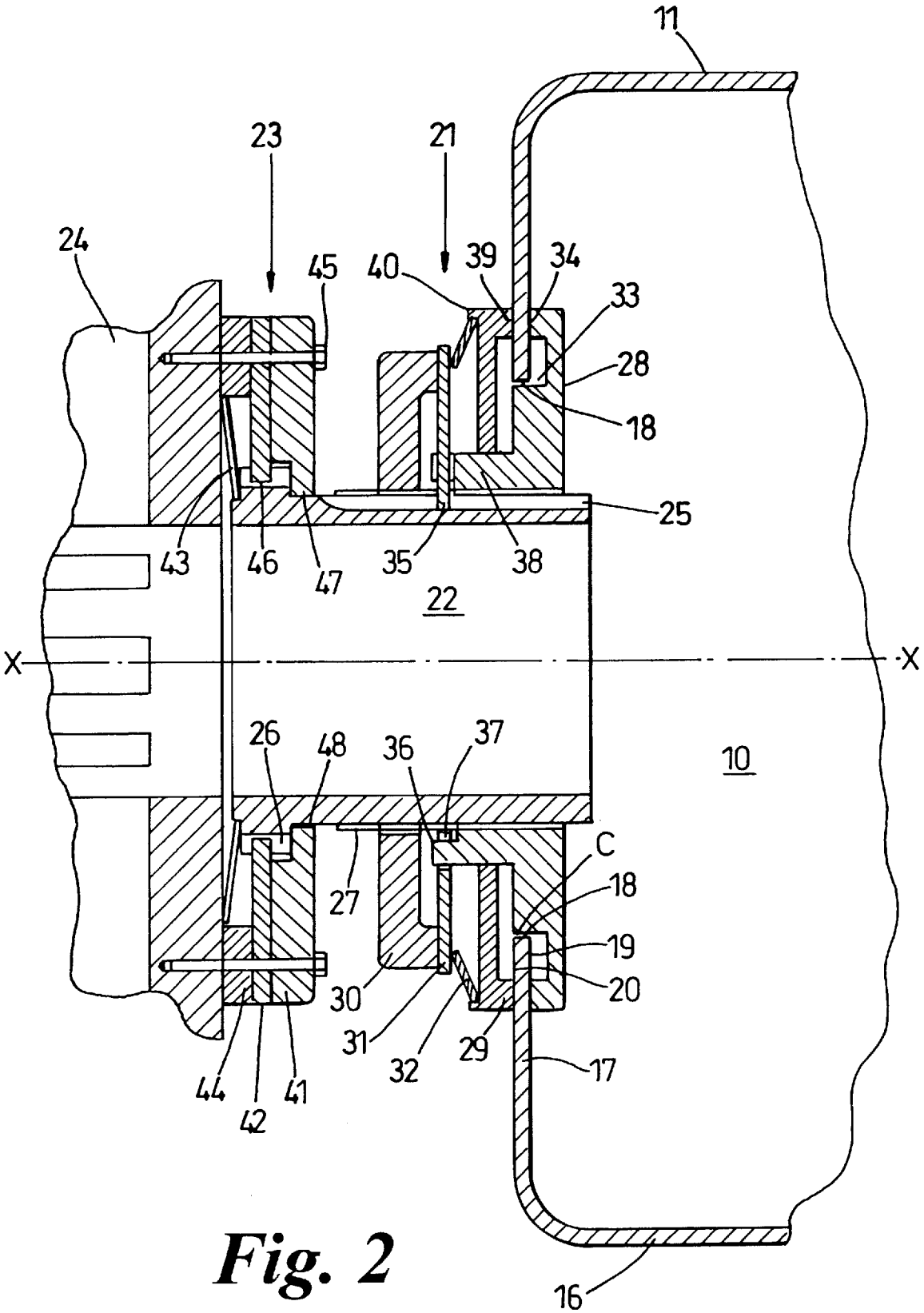
FIG. 2 is a enlarged view of the combustion chamber mounting illustrated in FIG. 1.

From FIG. 2 it will be noted that the external cylindrical surface of the mounting 22 is formed externally with a first series of longitudinal slots 25 for mounting the first attachment means 21, and with a second series of longitudinal slots 26 for mounting the second attachment means 23. The external cylindrical surface of the mounting 22 is also formed with a screw thread 27.

The first attachment means 21 comprises a downstream or inner clamp plate 28, an upstream or outer clamp plate 29, a locking nut 30, a lock washer 31 and a biasing means in the form of a frusto-conical, or Belleville, spring 32. The inner clamp plate 28 has an internal screw thread engaging the screw thread 27 and is thereby secured radially to the mounting 22 whilst permitting relative axial adjustment. The inner clamp plate 28 defines a spigot 33 which fits, as illustrated, within the slightly larger diameter of the circular aperture 18, leaving a clearance C whose size relative to adjacent components is shown exaggerated for clarity of illustration. The combustion chamber 10 is thereby located radially from both the inner clamp plate 28 and the mounting 22, with clearance C allowing for limited differential radial movement (expansion or contraction) between the ceramic combustor wall 17 and the combination of the mounting 22 and the attachment means 21. The combustion chamber 10 is axially located, relative to the mounting 22, by a clamp surface 34 which is defined by the inner clamp plate 28 and abuts the inner surface 19 of the radial wall 17, the relative axial position of the combustion chamber 10 being adjustable by rotating the inner clamp plate 28 relative to the mounting 22. The lock washer 31 is formed with inwardly directed integral tangs 35 which engage the first series of longitudinal slots 25, thereby preventing relative rotation between the lock washer 31 and the mounting 22 whilst permitting relative axial movement. When the inner clamp plate 28 has been adjusted to the required axial position, it is axially secured to the mounting 22 by sliding the locking washer 31 to the right, as seen in FIG. 2, until axially-directed pins or projections 36, formed integral with the inner clamp plate 28, are engaged within radial-slots 37 formed through the locking washer 31.

The outer clamp plate 29 is mounted, for axial movement, on a cylindrical hub 38 formed integral with the inner clamp plate 28, and defines a second clamp surface 39 which abuts the outer surface 20 of the radial wall 17. In this manner, the inner and outer surfaces 19, 20 of the radial wall 17 are gripped between the clamp surfaces 34, 39 under the action of the spring 32, thereby securing the combustion chamber 10 axially to the mounting 22. The locking nut 30 is also mounted on the screw thread 27 so that the force exerted by the spring 32 can be adjusted to a desired value by rotating the locking nut 30 relative to the mounting 22. After such adjustment, the locking nut 30 is secured to the locking washer 31 by known means, for example, either by wiring, or by deforming an outer edge portion of the locking washer 31 into an unshown detent in the adjacent peripheral edge of the locking nut 30. It will be noted that the locking nut 30 additionally serves to retain the locking washer 31 in engagement with the pins 36. The spring 32 is located by an annular lip 40 formed integral with the outer clamp plate 29.

In addition to securing the combustion chamber 10 to the mounting 22, the first attachment means 21 is designed to permit differential radial movement between the radial wall 17 and the clamp plates 28 and 29. This is achieved by choosing the force exerted by the spring 32 to permit radial slippage between the clamp plates 28, 29 and the abutting surfaces 19, 20 of the radial wall 17, thereby limiting the stresses that would otherwise have arisen due to radial expansion or contraction of the combustion chamber 10 relative to the first attachment means 21. This slippage is enhanced by coating the clamp surfaces 34, 39 with an abradable material such as that marketed under the designation METCO 314 NS. As the surfaces 19, 20 are formed of ceramic material, they are much harder and rougher than the metal clamp surfaces 34, 39. As a consequence, the ceramic surfaces 19, 20 become loaded with abraded particles of the coating thereby generating a smoother surface on the ceramic surfaces 19, 20 and facilitating relative movement in the plane of the radial wall 17. Other surface treatments may be used to reduce the friction between the clamp surfaces 34, 39 and the inner and outer walls 19, 20 irrespective of whether the combustion chamber is formed from ceramic or other material.

The second attachment means 23 comprises a clamp ring 41, a locking ring 42, a biasing means in the form of a frusto-conical spring 43, a spacer 44, and a series of bolts 45 which pass through and secure the clamp ring 41, the locking ring 42 and the spacer 44 to the support structure provided by the support structure 24.

The second series of longitudinal slots 26 engage tangs 46 formed integral with the locking ring 42, thereby preventing rotation of the mounting 22 relative to the support structure 24. The left-hand end of the tubular mounting 22 is enlarged, as shown, and is retained by an inwardly-directed annular flange 47 which is formed integral with the clamping ring 41 and resists the net axial combustion force applied to the combustion chamber 10.

The spring 43 reacts between the support structure 24 and the left-hand end of the mounting 22 with a force determined by the spring rating and the thickness of the spacer 44. In this manner, the mounting 22 and the attached combustion chamber 10 are located axially in the position shown in FIG. 2, whilst the spring 43 permits tilting movement of the combustion chamber 10 relative to the support structure 24; such tilting movement being caused by differential thermal movement between its downstream end 12 and its upstream end 16. The rating of spring 43 is chosen to be less than that of spring 32 to ensure that such tilting is only permitted in the region of spring 43. Thus, spring 32 accommodates only differential radial movement whilst spring 43 permits only tilting movement, the ratings of these springs being chosen to limit the stresses within the material forming the combustion chamber 10 to an acceptable level.

A working clearance 48 is provided between the flange 47 and the outer diameter of the mounting 22 to accommodate the required range of tilting movement of the mounting 22 relative to the support structure 24.

By way of an overview of the working of the above-described assembly, it may be noted that the first attachment means 21 accomniodates limited differential radial movement between the combustion chamber 10 and the mounting 22 in that the spring 32 biases the members 28, 30 together to clamp the combustor wall 17 between them in radially slideable fashion while simultaneously restraining axial movement of the combustor relative to the mounting 22. At the same time, the second attachment means 23 permits the mounting 22 (and hence the combustion chamber) to tilt a limited amount relative to the support structure 24, in that the spring 43 biases these two components apart by exerting a separation force between them, while simultaneously restraining relative radial movement between them, due to the abutment of the radially inner and outer edges of the spring 43 against the mounting 22 and the spacer 44 respectively.

Although the springs 32, 43 are illustrated as single frusto-conical spring washers, other forms of biasing means, such as wave springs, may be used.

In view of the high firing temperature within the combustion chamber 10, it may be necessary to cool at least some of the components of the first and second attachment means 21, 23 and the mounting 22. This can be achieved by arranging air passages in appropriate locations through the mounting.

In addition to controlling the level of stresses caused by thermal expansion and contraction, it should be noted that the axial forces exerted by the springs 32 and 43 should also be chosen to take due account of the oscillating combustion forces within the combustion chamber 10 and the range of the residual axial force exerted on, the combustion chamber 10, to ensure that the system will not vibrate.

I claim:

1. A gas turbine engine having a combustion chamber secured to a mounting by a first attachment means arranged to accommodate differential radial movement between the combustion chamber and the mounting, the mounting being secured to a support structure by a second attachment means arranged to permit the combustion chamber to tilt relative to the support structure, the first attachment means extending through an aperture in a wall of the combustion chamber and defining a pair of opposed surfaces shaped respectively to engage inner and outer surfaces of the combustion chamber wall adjacent the aperture, the first attachment means including a biasing means operative to cause the opposed surfaces to grip the inner and outer surfaces of the combustion chamber wall with a force sufficient to secure the combustion chamber to the mounting while permitting differential radial movement between the combustion chamber wall and the opposed surfaces, one of the opposed surfaces being defined by a first member that is axially secured to the mounting, the other opposed surface being defined by a second member that is mounted for axial movement relative to the mounting, and the biasing means being arranged to react between the mounting and the second member.

2. The gas turbine engine according to claim 1, including an axial adjustment device arranged operatively between the first member and the mounting to enable the position of said one opposed surface to be adjusted axially of the mounting.

3. The gas turbine engine according to claim 1, in which the first member is positioned within the combustion chamber.

4. A gas turbine engine having a combustion chamber secured to a mounting by a first attachment means arranged to accommodate differential radial movement between the combustion chamber and the mounting, the mounting being secured to a support structure by a second attachment means arranged to permit the combustion chamber to tilt relative to the support structure, the combustion chamber being formed of a ceramic material, the first attachment means having surfaces that are to contact the ceramic combustion chamber, the surfaces being coated with an abradable metallic material.

5. A combination of a combustion chamber and a mounting, comprising: a first attachment means for securing the combustion chamber to the mounting, said first attachment means being capable of accommodating limited differential radial movement between the combustion chamber and the mounting, the mounting further having a second attachment means for securing the mounting to a support structure, said second attachment means being capable of permitting the mounting, and hence, the combustion chamber, to tilt a limited amount relative to the support structure, the first and second attachment means comprising respective first and second bias means, the first bias means being arranged to restrain axial movement of the combustion chamber relative to the mounting, and the second bias means being arranged to restrain radial movement of the mounting relative to the support structure.

6. The combination according to claim 5, in which the first bias means includes a pair of clamp members, the clamp members being urged together by spring means to grip a wall of the combustor therebetween.

7. The combination according to claim 1, in which the second means includes spring means for exerting a separation force between the support structure and the mounting.

8. A gas turbine engine having a combustion chamber secured to a mounting by a first attachment means arranged to accommodate differential radial movement between the combustion chamber and the mounting, the mounting being secured to a support structure by a second attachment means arranged to permit the combustion chamber to tilt relative to the support structure, the first and second attachment means comprising respective first and second bias means, the first bias means being arranged to restrain axial movement of the combustion chamber relative to the mounting, and the second bias means being arranged to restrain radial movement of the mounting relative to the support structure.

9. The gas turbine engine according to claim 8, in which the first attachment means extends through an aperture in a wall of the combustion chamber and defines a pair of opposed surfaces shaped respectively to engage inner and outer surfaces of the combustion chamber wall adjacent the aperture, and the first attachment means also includes a biasing means operative to cause the opposed surfaces to grip the inner and outer surfaces of the combustion chamber wall with a force sufficient to secure the combustion chamber to the mounting while permitting differential radial movement between the combustion chamber wall and the opposed surfaces.

10. The gas turbine engine according to claim 9, in which one of the opposed surfaces is defined by a first member that is axially secured to the mounting, the other opposed surface is defined by a second member that is mounted for axial movement relative to the mounting, and the biasing means is arranged to react between the mounting and the second member.

11. The gas turbine engine according to claim 8, in which the mounting is tubular and surrounds a fuel burner.

12. The gas turbine engine according to claim 11, in which the support structure is an air inlet guide vane communicating with the combustion chamber through the tubular mounting.

13. The gas turbine engine according to claim 8, in which the mounting includes at least one duct for the passage of cooling air.

14. The gas turbine engine according to claim 8, in which the combustion chamber is formed of a ceramic material.

15. The gas turbine engine according to claim 14, in which the ceramic material comprises woven continuous fibers embedded in a silicon carbide matrix.

16. The gas turbine engine according to claim 14, in which surfaces of the first attachment means that are to contact the ceramic combustion chamber are coated with an abradable metallic material.

* * * * *